US012484722B2

(12) United States Patent
Brady

(10) Patent No.: US 12,484,722 B2
(45) Date of Patent: Dec. 2, 2025

(54) TRAVEL PILLOW

(71) Applicant: Steven C. Brady, Boise, ID (US)

(72) Inventor: Steven C. Brady, Boise, ID (US)

( * ) Notice: Subject to any disclaimer, the term of this patent is extended or adjusted under 35 U.S.C. 154(b) by 368 days.

(21) Appl. No.: 17/805,423

(22) Filed: Jun. 3, 2022

(65) Prior Publication Data

US 2023/0389733 A1 Dec. 7, 2023

(51) Int. Cl.
*A47G 9/10* (2006.01)
*A47C 7/38* (2006.01)

(52) U.S. Cl.
CPC ..... *A47G 9/1081* (2013.01); *A47C 7/383* (2013.01); *A47G 9/1009* (2013.01); *A47G 2009/1018* (2013.01); *A47G 9/1027* (2013.01); *A47G 9/1036* (2013.01); *A47G 9/1045* (2013.01)

(58) Field of Classification Search
CPC ..... A47G 9/1081; A47G 2009/1018; A47G 9/10; A47G 9/1009; A47G 9/109; A47G 9/1027; A47G 9/1036; A47G 9/1045; A47G 9/1054; A47G 9/1063; A47G 9/1072; A47C 7/383; A47C 7/386; A47C 7/36; A47C 7/38; B64D 11/0642; B64D 11/0646
USPC .... 5/636, 640, 637, 643, 628; 297/399, 393, 297/397
See application file for complete search history.

(56) References Cited

U.S. PATENT DOCUMENTS

| | | | | |
|---|---|---|---|---|
| 4,964,418 | A * | 10/1990 | Wilson | A61F 5/05883 5/636 |
| 7,788,749 | B1 * | 9/2010 | Ku | A47C 5/005 5/643 |
| 8,584,285 | B1 | 11/2013 | Sipherd | |
| 8,898,840 | B1 | 12/2014 | Majette | |
| D754,454 | S | 4/2016 | Schwingendorf | |
| D778,086 | S | 2/2017 | O'Meara et al. | |
| 9,615,682 | B1 | 4/2017 | Maddocks et al. | |
| 9,867,486 | B2 | 1/2018 | Scrimshaw et al. | |
| 9,888,793 | B2 | 2/2018 | Walker | |
| 11,129,478 | B2 | 9/2021 | Sternlight et al. | |
| 2003/0135927 | A1 | 7/2003 | Hsia | |
| 2009/0019641 | A1 * | 1/2009 | Ali | B60N 2/885 5/636 |
| 2013/0232693 | A1 | 9/2013 | Myers | |
| 2015/0257555 | A1 | 9/2015 | Wong | |
| 2017/0197529 | A1 * | 7/2017 | Hontz | B60N 2/885 |
| 2020/0093274 | A1 * | 3/2020 | Tat | A47C 16/00 |

* cited by examiner

*Primary Examiner* — Justin C Mikowski
*Assistant Examiner* — Deborah Talitha Gedeon
(74) *Attorney, Agent, or Firm* — Shaver Swanson; Scott D. Swanson

(57) ABSTRACT

A travel pillow that is transported in a flat or closed position. The travel pillow has a pillow body that is configured to support an occipital region of a user's head and upper neck in an opened position. The pillow body has two wings attached to a back side of the travel pillow. Each wing each has a first end attached to the pillow body. Each wing extends inward along the pillow body from the attachment to the pillow body. The inner end of each wing is free from the pillow body. The first end each wing is bent outward away from the pillow body, causing the pillow body to flex and bend into a u-shape. The u-shape cups a user's head and neck with the wings providing a base or support to the travel pillow.

7 Claims, 4 Drawing Sheets

TRAVEL PILLOW

FIELD OF THE INVENTION

The present invention generally relates to the field of travel pillows, and more particularly to the field of travel pillows being movable from a storage configuration to a use configuration.

BACKGROUND OF THE INVENTION

Millions of people travel via airplanes, trains, and passenger automobile each day. These passengers often rest and/or sleep on these trips. Typically the passenger is in a seated position, in anatomical terms called the Fowler's position. However, the Fowler's position in an upright chair is not ideal for sleeping. A traveler's head can slide to one side or the other, or the traveler's neck can bend due to the weight of the traveler's head. This can provide an uncomfortable position and can cause discomfort in the traveler's neck even after the trip has ended.

SUMMARY

The purpose of the following summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the invention of the application, which is measured by the claims, nor is it intended to be limiting as to the scope of the invention in any way.

What is disclosed is an improved travel pillow. The travel pillow has a pillow body. The pillow body extending a length between a first body end and a second body end. The pillow body has a support face and a wing face. The pillow body is flexible so as to be configured to be bent or flexed from a flat storage orientation to a travel orientation. In the travel orientation the pillow body is bent or flexed such that said support face cups the occipital region and neck of a person. This cup provides support to a user's head when the user is in a seated position, such as in an airplane, bus, or train seat. Preferably the pillow body has one or more depressions or contours to match the occipital region of a user's head and neck. For example, in a preferred embodiment the pillow provides an hour glass shape.

Two opposing wings are attached to the wing face of the pillow body. The opposing wings are denoted a first wing and a second wing. Each of the opposing wings has a wing body extending between a fixed wing end and a free wing end. Each of the opposing wings is attached to the pillow body at the fixed wing end. Each wing body extends inward such that the free wing end is positioned interior to the fixed wing end. Preferably the wing body is planar or flat, and each of the opposing wings is planar or flat. This allows for an overall flat appearance with the wings positioned on or stacked on the pillow body. The pillow body can be made of several layered components, such as layers of foam, or alternatively a uniform configuration can be utilized. The opposing wings and pillow body can be constructed of foam or other bendable material, such as an inflatable plastic material.

In the storage position each of the opposing wings extends along said pillow body toward the opposing wing and the center of the pillow body. Each wing body is positioned against the pillow body from the fixed wing end to the free wing end. Preferably the wings have a flat inner face that is against the pillow body in the storage position and an outer face that faces away from the pillow body. The free wing ends are positioned proximate to a center of the pillow body. Each of the opposing wings is configured such that the free end of said each of said opposing wings is movable away from said pillow body causing the pillow body to bend inward into a U-shape, providing the travel configuration. The opposing wings support the pillow body in the U-shape when a force from a user's head is positioned in said U-shape. In a preferred embodiment the wings are rotated outward such that the inner face of each wing proximate to the free end of each wing has rotated approximately 180 degrees to be positioned flat against a seat back or other substrate to provide support to the cupped pillow body.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DETAILED DESCRIPTION OF THE INVENTION

Figure 1:
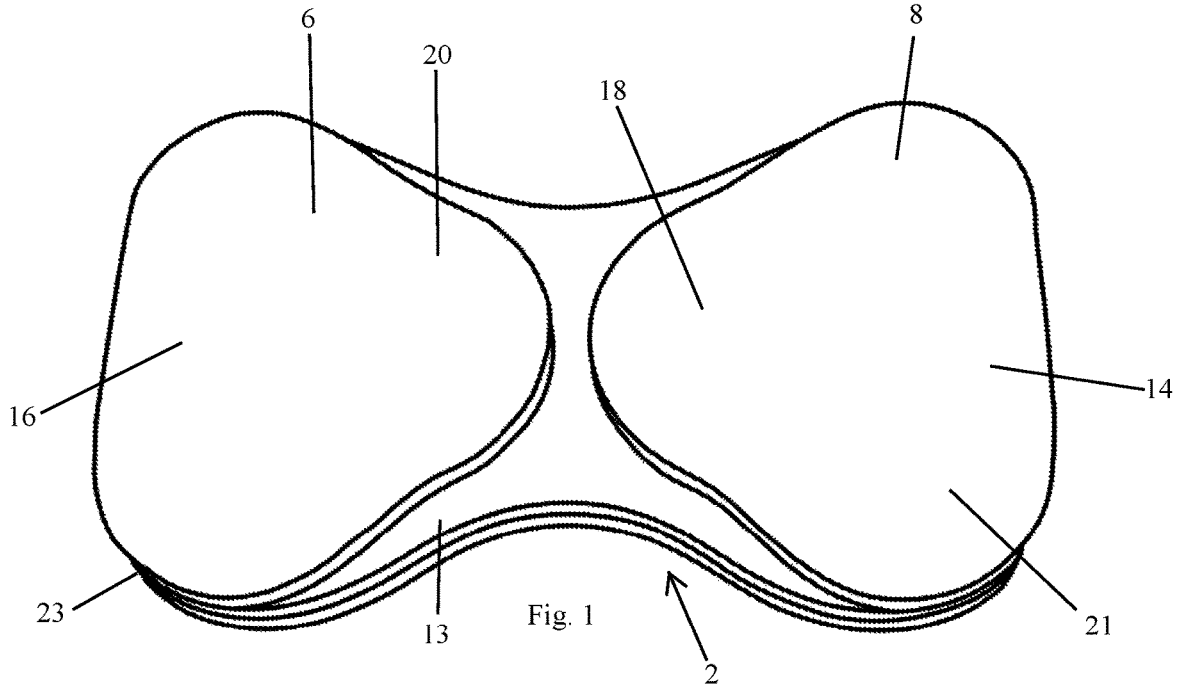
FIG. 1 illustrates a back view of a preferred embodiment of a travel pillow.

While the invention is susceptible of various modifications and alternative constructions, certain illustrated embodiments thereof have been shown in the drawings and will be described below in detail. It should be understood, however, that there is no intent to limit the invention to the specific form disclosed, but, on the contrary, the invention is to cover all modifications, alternative constructions, and equivalents falling within the spirit and scope of the invention as defined in the claims.

FIGS. 1-8 illustrates the preferred embodiment of a travel pillow according to the disclosed inventive concepts. FIG. 1 illustrates the top view of a person utilizing the travel pillow. The travel pillow 2 has a pillow body 4. The pillow body is constructed of a flexible or pliable material that is configured to bend when a user utilizes the travel pillow. The travel pillow has two opposing wings 6, 8 that are attached to the pillow body at opposite ends of the pillow body. The wings are attached at a first end and extend inward along the pillow body. The wings are partially free or otherwise affixed to the pillow body such that a portion of the wings is capable of folding from a closed position, (Illustrated in FIG. 4-6) to an extended or in use position (illustrated in FIGS. 1-3, 7-8).

FIG. 1 illustrates a view of the travel pillow in a folded or stowable position. In the folded position the travel pillow provides a generally planer appearance. The back of the travel pillow illustrates two opposing wings 14-16 attached to the wing face (or back side) 13 of the pillow body. The opposing wings 6, 8 have two ends generally aligned with the two opposing ends of the pillow body 21, 23. The wings are attached to the pillow body at the outside ends 14, 16 of the wings to the outside ends 21, 23 of the pillow body. The interior ends 18, 20 of the wings are free from the pillow body so as to allow the wings to bend and rotate outward from the closed position to an extended or open position shown, for example, in FIGS. 4 and 5.

Figure 2:
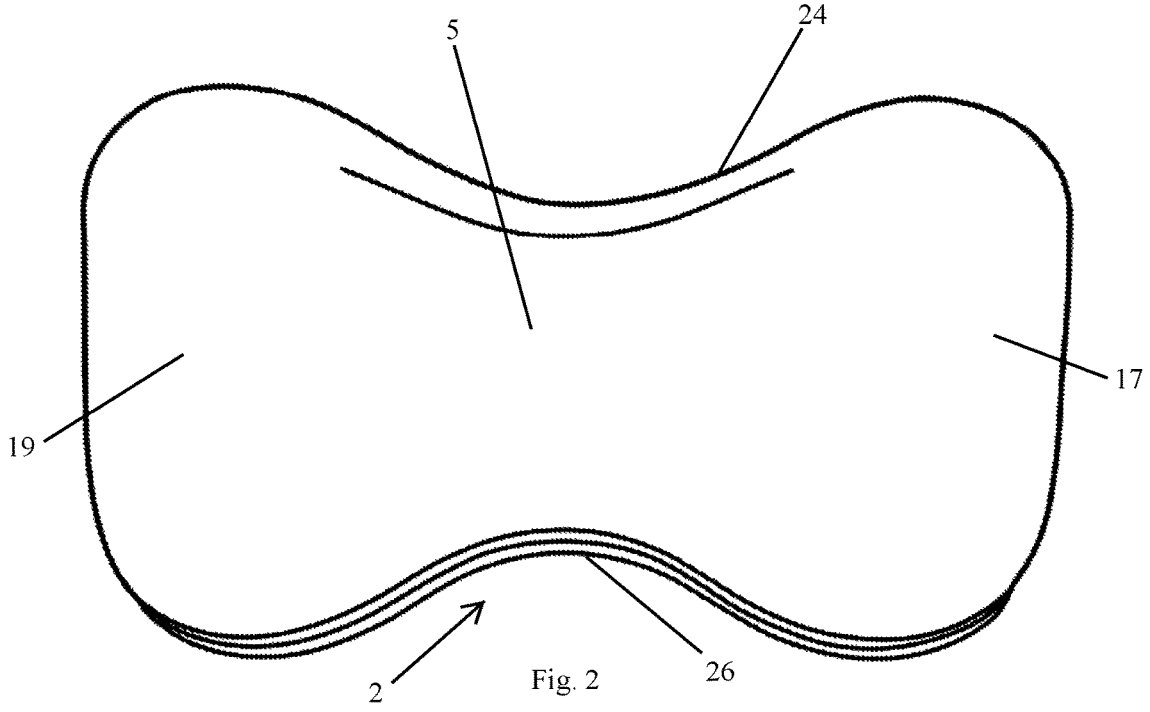
FIG. 2 illustrates a top view of the travel pillow of the preferred embodiment.

FIG. 2 illustrates the front side of the travel pillow. The front side of the travel pillow body 5 is generally planer. The depicted embodiment has two depressions or contours positioned generally at the center of the travel pillow. These depressions are configured 4 to align with the occipital region of a user's head and upper neck. The depicted pillow body has the general shape of an hour glass.

Figure 3:
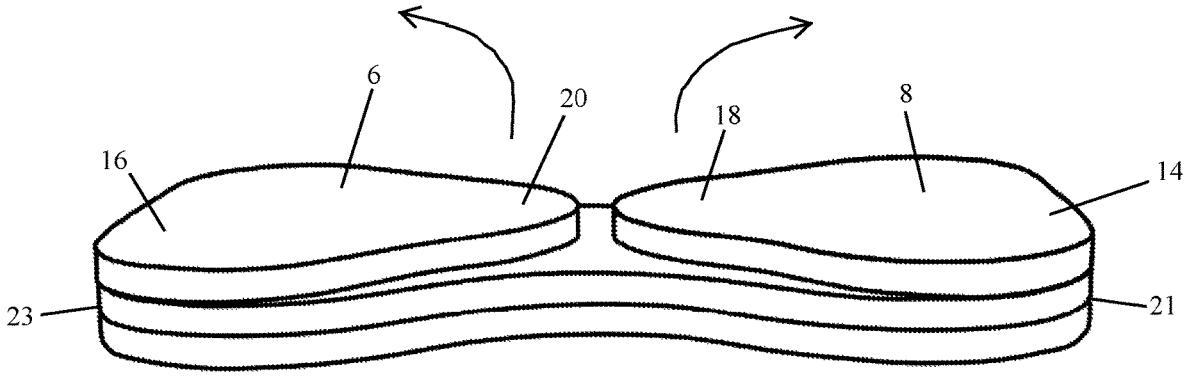
FIG. 3 illustrates a side perspective view of the travel pillow shown in FIGS. 1-2 in a flat or portable position.

FIG. 3 illustrates a side perspective view of the travel pillow in a flat or travel position. Arrows O indicate the direction of opening of each of the wings in use. When a user opens the wings, the flexible body allows the ends of the pillow body 21, 23 to rotate away from the bending of the wings thus providing a cup to the occipital area as shown in FIG. 4.

Figure 4:
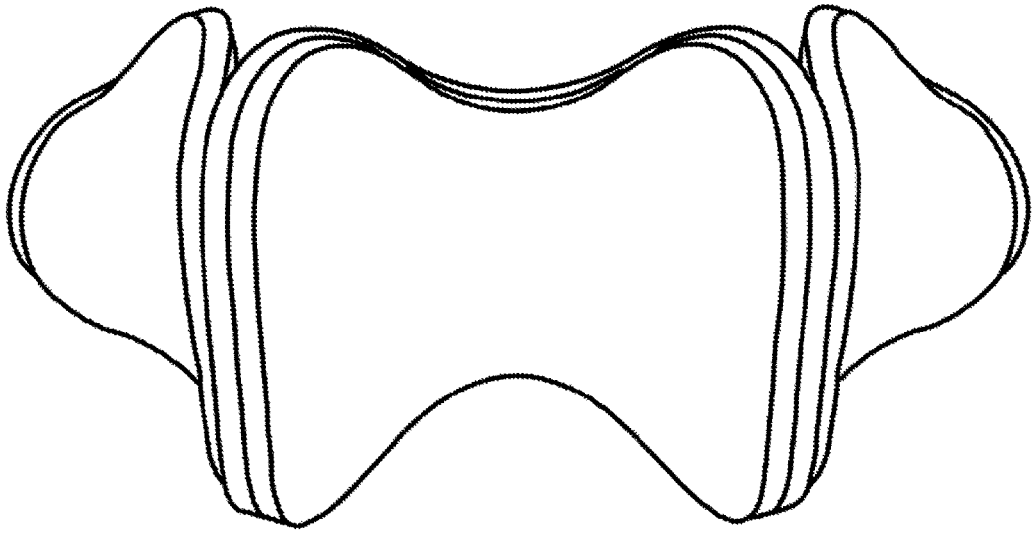
FIG. 4 illustrates the travel pillow of FIGS. 1-3 in an open or supporting position.

FIG. 4 illustrates the wings open with the pillow body bent or curved to accommodate a user's occipital region of the user's head and upper neck.

Figure 5:
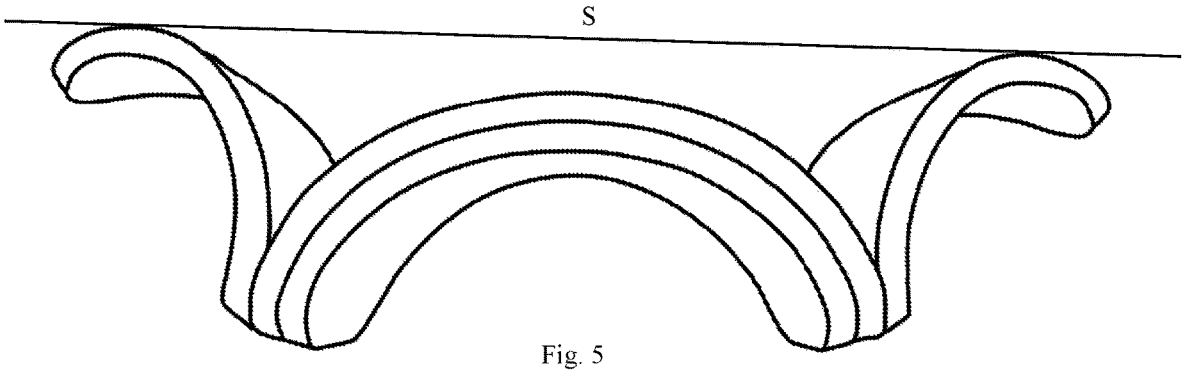
FIG. 5 illustrates a top view of the travel pillow of FIGS. 1-4 in the open or supportive position.

FIG. 5 illustrates a top view of the opened wings and curvature of the pillow body. In the depicted embodiment the pillow body is shown utilizing two separate pieces attached. However, a unitary body can be utilized, or multiple components attached. A foam structure is contemplated in the depicted drawings; however an inflatable or air-filled device can similarly provide the same function. The substrate S is illustrated as a line. The substrate can be a seat back or other surface against which the pillow is used.

Figure 6:
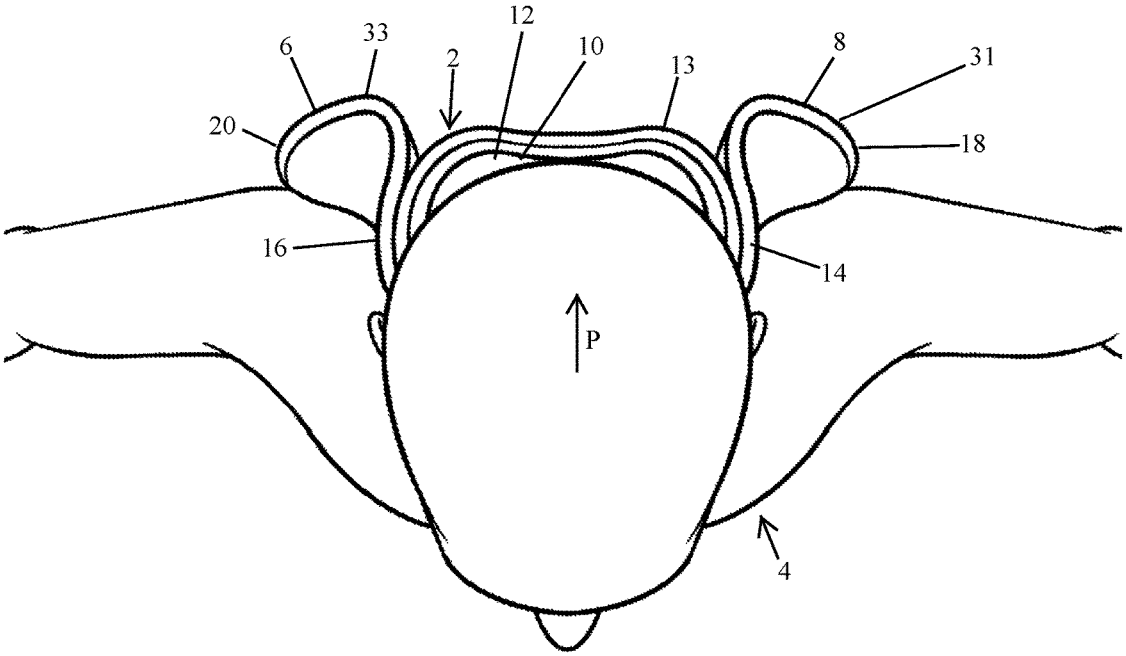
FIG. 6 illustrates a top view of a user utilizing the travel pillow of FIGS. 1-5.
Figure 7:
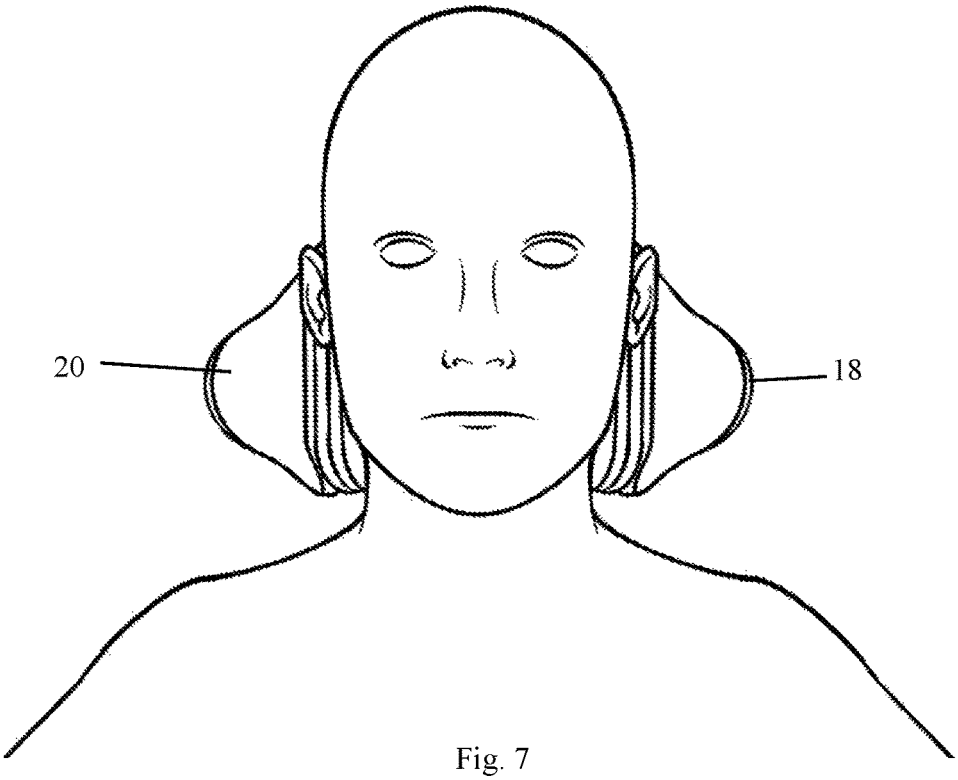
FIG. 7 illustrates a front view of a user utilizing the travel pillow of FIGS. 1-6 in the open or supportive position.
Figure 8:
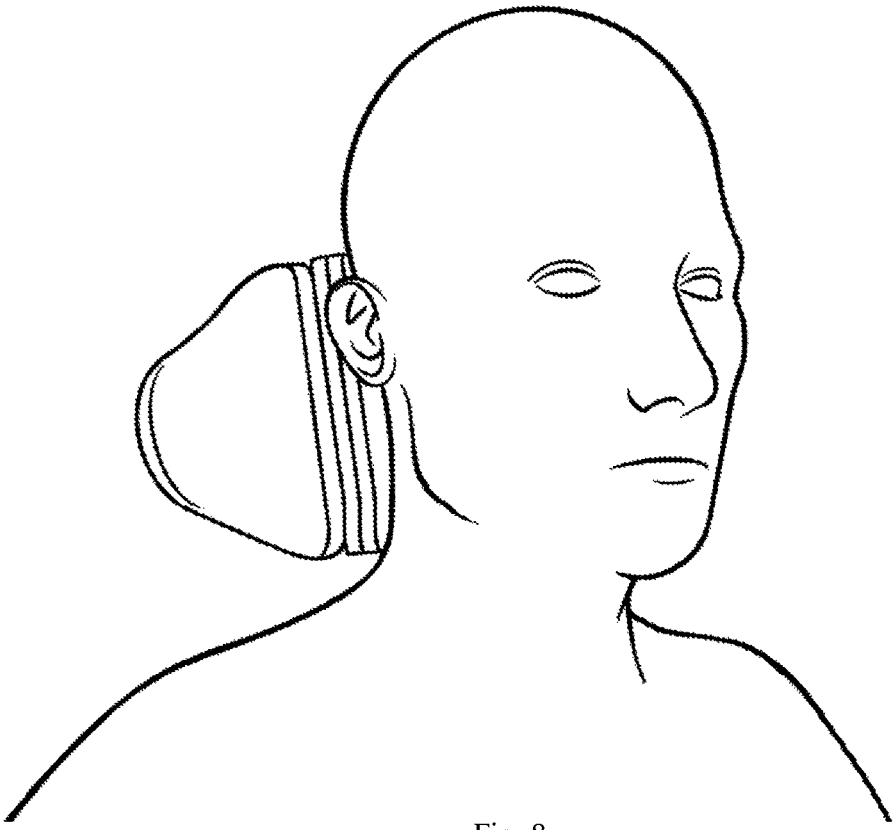
FIG. 8 illustrates a side perspective view of the travel pillow of FIGS. 1-7 in the open or supportive position.

FIGS. 6-8 illustrate the depicted embodiment with a user's occipital region and upper neck supported by the pillow. The substrate supporting the opposing wings is not shown to provide improved illustration of the travel pillow. FIG. 6 illustrates a top view of the embodiment of a travel pillow in use. A user has expanded the wings, causing the pillow body to bend to provide a U-shape cupping the occipital region of the User's head and the upper portion of the user's neck. The wings are positioned with the underside 31 or inner face, 33 of each wing positioned against the substrate. The force of the user's weight against the front of the body 12 allows the front of the body 12 to provide a cupping of the occipital region of the user's head while the wings 6, 8 support the travel pillow, providing a counter force retaining supporting the pillow body. In this configuration the travel pillow provides a stable, supportive pillow for use in travel. In particular, the travel pillow is useful a user is trying to sleep or rest in a seated position, such as in the Fowler's position.

FIG. 7 illustrates the front view of a user with the occipital region of the user's head and upper neck positioned in the travel pillow. The wings 18, 20 have been extended outward to provide a support pedestal to the cupped body of the travel pillow. The flexing of the wings against the body combined with the user's head positioned in the cup prevent the travel pillow from collapsing. The opposing forces provided by the wings positioned against the substrate and the user's head and neck against the pillow allow the travel pillow to maintain the u-shaped cup of the pillow body coupled with the opposing support of the wings.

FIG. 9 illustrates a side perspective view of a user's head positioned in the travel pillow. The user's occipital region of the user's head and neck are positioned within the depressions of the hourglass shaped pillow body.

While there is shown and described the present preferred embodiment of the invention, it is to be distinctly understood that this invention is not limited thereto, but may be variously embodied to practice within the scope of the following claims. From the foregoing description, it will be apparent that various changes may be made without departing from the spirit and scope of the invention as defined by the following claims.

What is claimed is:

1. A travel pillow comprising:

a pillow body, said pillow body extending a length between a pillow body first end and a pillow body second end and having a support face and a wing face, wherein said body is flexible so as to be configured to be bent from a flat storage orientation to a curved travel orientation in which said body is curved such that said support face is configured to cup the occipital region and neck of a person;

two opposing wings comprising a first wing and a second wing, wherein each of said wings has a fixed wing end and a free wing end and an inner face, wherein the inner face at the fixed wing end of a first of said opposing wings is attached to said wing face proximate to said pillow body first end and wherein the inner face at the fixed wing end of a second of said opposing wings is attached to said wing face proximate to said pillow body first end; and wherein in said flat storage orientation each of said opposing wings extends along said pillow body toward the opposing wing and a center of said pillow body such that each wing body is positioned against the pillow body from said fixed wing end to said free wing end with said free wing ends positioned proximate a center of said pillow body, wherein each of said opposing wings is configured such that said free end of said each of said opposing wings is movable away from said pillow body causing said fixed ends to bend said pillow body first end and second end in an opposite direction from a direction of movement of said free ends and moving said pillow body to a U-shape in a travel configuration, wherein in said travel configuration said opposing wings are configured to flex to a curved orientation to support said pillow body with said wings directly positioned against a substrate when a force from a user's head is positioned in said U-shape.

2. The travel pillow of claim 1, wherein said pillow body comprises a planar body shape in said flat storage orientation, wherein said opposing wings each comprises a planar wing shape, wherein said planar body shape and said planar wing shapes are parallel in said flat storage orientation.

3. The travel pillow of claim 1, wherein said pillow body comprises a plurality of support layers.

4. The travel pillow of claim 1, wherein said pillow body and said opposing wings comprise a foam material.

5. The travel pillow of claim 1, wherein said pillow body comprises a depression configured for supporting the occipital region of a user's head.

6. The travel pillow of claim 1, wherein said pillow body comprises a depression configured for supporting the neck of a user's head.

7. The travel pillow of claim 1, wherein in said travel orientation the inner face at the free end of each of said opposing wings is configured for positioning against a support substrate to support said pillow body in said U-shape.

* * * * *